US010154771B2

(12) United States Patent
Kelly-Murray et al.

(10) Patent No.: US 10,154,771 B2
(45) Date of Patent: Dec. 18, 2018

(54) CLEANING SYSTEM FOR A LOW TEMPERATURE FILL-AND-DUMP DISHWASHING MACHINE

(71) Applicant: The Procter & Gamble Company, Cincinnati, OH (US)

(72) Inventors: Kristin Marie Kelly-Murray, Cheviot, OH (US); Alan Edward Sherry, Newport, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 271 days.

(21) Appl. No.: 14/170,801

(22) Filed: Feb. 3, 2014

(65) Prior Publication Data

US 2014/0251385 A1 Sep. 11, 2014

Related U.S. Application Data

(60) Provisional application No. 61/760,345, filed on Feb. 4, 2013.

(51) Int. Cl.

| | |
|---|---|
| ***A47L 15/00*** | (2006.01) |
| ***C11D 3/386*** | (2006.01) |
| ***C11D 3/395*** | (2006.01) |
| ***C11D 7/10*** | (2006.01) |

(52) U.S. Cl.

CPC ..... *A47L 15/0007* (2013.01); *A47L 15/0005* (2013.01); *A47L 15/0015* (2013.01); *A47L 15/0076* (2013.01); *C11D 3/386* (2013.01); *C11D 3/395* (2013.01); *C11D 7/10* (2013.01); *A47L 2601/20* (2013.01)

(58) Field of Classification Search

CPC ..... A47L 15/0002; A47L 15/0076; A47L 15/0078

See application file for complete search history.

(56) References Cited

U.S. PATENT DOCUMENTS

| | | | | |
|---|---|---|---|---|
| 4,776,359 | A * | 10/1988 | Federighi, Jr. | A47L 15/4291 134/111 |
| 4,810,306 | A * | 3/1989 | Noren | A47L 15/0002 134/103.1 |
| 5,876,514 | A * | 3/1999 | Rolando | C11D 1/008 134/25.2 |
| 2004/0121926 | A1* | 6/2004 | Waits et al. | 510/221 |
| 2005/0137107 | A1* | 6/2005 | Griese | C11D 11/0023 510/220 |
| 2012/0291818 | A1* | 11/2012 | Monsrud et al. | 134/36 |

FOREIGN PATENT DOCUMENTS

| | | | | |
|---|---|---|---|---|
| WO | WO 2011161459 | * | 12/2011 | C11D 3/386 |

* cited by examiner

*Primary Examiner* — Mikhail Kornakov
*Assistant Examiner* — Pradhuman Parihar
(74) *Attorney, Agent, or Firm* — Abbey A. Lopez

(57) ABSTRACT

A method of cleaning dishware in a low temperature fill-and-dump dishwashing machine wherein the detergent composition doused in the wash cycle comprises sanitizer mitigator and enzymes, and the rinse cycle comprises sanitizer and rinse aid.

12 Claims, 2 Drawing Sheets

CLEANING SYSTEM FOR A LOW TEMPERATURE FILL-AND-DUMP DISHWASHING MACHINE

TECHNICAL FIELD

The present invention is in the field of professional cleaning systems and their method of use in low temperature fill-and-dump dishwashing machines. More specifically, the invention is in the field of cleaning systems comprising a detergent composition having enzyme and sanitizer mitigator, in combination with sanitizer in low temperature fill-and-dump professional dishwashing machines.

BACKGROUND OF THE INVENTION

Low temperature fill-and-dump dishwashing machines are widely used in North American commercial and institutional eating establishments, such as delis, bars, fast food chains, private owner restaurants and cafeterias. Low temperature fill-and-dump dishwashing machines can take many forms such as under-counter machines, door 'pass through' machines, conveyor machines, or flight machines. Regardless of their form, all of these low temperature fill-and-dump machines have the same life cycle of water flow during the wash and rinse/sanitize cycles. At the beginning of a wash cycle for a low temperature fill-and-dump machine, detergent is dispensed into the machine which is filled with pre-heated water. Actuation of the low temperature fill-and-dump machine to start the wash cycle can take place, for example, by opening and shutting the door of a pass through machine, or via a sensing mechanism that detects the introduction of a rack into the machine.

Following the wash process, the built-in machine drain opens to 'dump' the wash solution containing the detergent to a holding tank or an outside drain. Just before the machine drain closes, the water fill is actuated thus creating a flush cycle, after which the drain closes. Fresh water, rinse aid, and sanitizer are then dispensed into the machine in the rinse cycle, and following completion of the rinse cycle, the machine operation shuts down until it is again actuated. The rinse water fill becomes the water for the next set of ware to be washed, after which it is once again drained out. The water filling at the beginning of the rinse cycle and water dumping at the end of each wash cycle is what makes a professional washing machine 'low temperature fill-and-dump.'

Low temperature fill-and-dump machines use a sanitizer, such as chlorine or iodine, to sanitize the dishware before it is removed from the machine. The use of a chemical sanitizer is mandated for low temperature fill-and-dump machines that do not achieve sufficient temperatures (around 80° C.) for hot water sanitization to be effective within the time frame in which the sanitization takes place, typically 15-20 seconds. Low temperature fill-and-dump machines operate at a temperature of from about 49° C. to about 60° C. Unfortunately, the mandated sanitizer reacts negatively with most detergent enzymes that are present for effective dishware cleaning.

The art recognizes the benefits of enzyme-based detergents for use in commercial dishwashing machines that sanitize using hot water, but is silent on enzyme-based detergents for use in low temperature fill-and-dump machines that are required to use chemical sanitizers. Therefore, a need exists for a cleaning system that provides for enzymatic cleaning in a chemical sanitizer, low temperature low temperature fill-and-dump machine.

SUMMARY OF THE INVENTION

A method of cleaning dishware in a low temperature fill-and-dump dishwashing machine comprising: (a) placing a detergent composition in a low temperature fill-and-dump dishwashing machine during the machine wash cycle, the detergent composition comprising at least one enzyme and at least one sanitizer mitigator; and (b) adding a sanitizer during the machine rinse cycle, wherein the sanitizer comprises at least one chlorine or iodine-based compound.

A kit for cleaning dishware in a low temperature fill-and-dump dishwashing machine, the kit comprising: (a) a detergent composition comprising at least one enzyme and at least one sanitizer mitigator; (b) a sanitizer and a rinse aid, wherein the sanitizer comprises at least one chlorine or iodine-based compound; and (c) instructions for placing the detergent composition in a low temperature fill-and-dump dishwashing machine during the machine wash cycle, and instructions for addition the sanitizer during the machine rinse cycle.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION

Definitions

Figure 1:
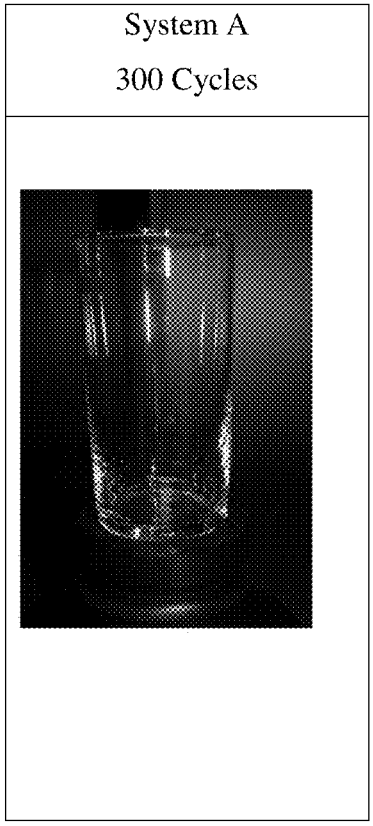
FIG. 1 is an image of glassware that has been repeatedly cleaned using the system of the present invention.

"Low temperature" refers to commercial dishwashers that rely on a legally mandated chemical additive to sanitize dishware. The mandated sanitizer, either iodine or chlorine, is required due to the fact that 'low temperature' machines do not achieve a temperature of 80° C. (180° F.) or higher, which is the temperature necessary to effectively kill germs on dishware.

"Fill and dump" commercial dishwashers are dishwashers that fill up to provide fresh water for the rinse cycle of a first set of dishware and wash water for a second set of dishware; following removal of the first set of dishware and introduction of a second set of dishware into the machine, the water is then dumped.

"In-use wash detergent pH" refers to a pH that is measured as a 1% solution of the wash detergent composition in de-ionized water at room temperature (about 25° C.). In cases where two or more detergent compositions are dosed and diluted into the wash composition, the pH measurement is performed on a solution comprising 1% solution of each composition in de-ionized water. For example, supposing two detergent compositions are dosed and diluted into the machine during the wash cycle, a 2% solution of each detergent composition can first be prepared in de-ionized water followed by an equal weight blending of the two diluted compositions. The pH measurement is then performed on the blended solution comprising 1% of each wash detergent composition.

Chemical sanitizers in low temperature fill-and-dump dishwashing machines are known to degrade enzymes present in detergent compositions and eliminate the contribution that these enzymes provide for dishware cleaning. It has been surprisingly found that good cleaning results can be obtained in low temperature fill-and-dump dishwashing machines by adding enzymes and a sanitizer mitigator in the machine wash cycle, in combination with the required sanitizer during the machine rinse cycle. This allows for optimization of the enzyme while still meeting the requirements of sanitizer in the low temperature fill-and-dump dishwashing machine.

In one embodiment, the dishware in a low temperature fill-and-dump washing machine is cleaned by (a) placing a detergent composition in a low temperature fill-and-dump dishwashing machine during the machine wash cycle, the detergent composition comprising at least one enzyme and at least one sanitizer mitigator; and then (b) adding a sanitizer during the machine rinse cycle, wherein the sanitizer comprises at least one chlorine or iodine-based compound.

In another embodiment, the sanitizer mitigator is added separately from the at least one enzyme. The at least one enzyme may be added either before or after the sanitizer mitigator so long as both the sanitizer mitigator and the at least one enzyme are both added during the wash cycle of the low temperature fill-and-dump dishwashing machine.

In another embodiment, a sanitizer and optionally a rinse aid composition are placed in the low temperature fill-and-dump dishwashing machine during the machine rinse cycle. In another embodiment, a buffering agent is added to the detergent composition added during the machine wash cycle. Any combination of the above embodiments may be used so long as the at least one enzyme and the sanitizer are added in separate cycles of the low temperature fill-and-dump dishwashing machine.

A. Wash Cycle Components

Enzyme

Suitable enzymes for use in the detergent composition include amylases, proteases, lipases, and mixtures thereof. Enzymes are well known in the art as biological catalysts that can assist in the breakdown of complex soils, including food soils. Amylases are typically included in detergent compositions to aid in starch removal; proteases for protein removal; and lipases or phopholipases for lipid and fatty soil removal. As food soils on dishware typically consist of complex mixtures of soil types, the detergent composition of the present invention may comprise at least one enzyme, in another embodiment at least two or more differing enzymes.

In one embodiment, the detergent composition comprises at least one amylase and at least one protease for both starch soil cleaning and for protein soil cleaning. In another example, the detergent composition comprises at least one amylase and at least one lipase or phospholipase. In yet another embodiment, the detergent composition comprises an amylase and a protease in one composition, and a lipase or phospholipase in a separate detergent composition.

In one embodiment, the enzyme is a protease, wherein the protease demonstrates at least 90%, in one embodiment at least 95%, in another embodiment at least 98%, in another embodiment at least 99%, and in a final embodiment 100% identity with the wild-type enzyme from *Bacillus lentus*. The protease comprises mutations in one or more, in another embodiment two or more, in another embodiment three or more, of the following positions using the BPN' numbering system and amino acid abbreviations as illustrated in WO00/37627: 9, 15, 61, 68, 76, 87, 99, 101, 103, 104, 118, 128, 129, 130, 167, 170, 194, 205, 222 & 245 and optionally one or more insertions in the region comprising amino acids 95-103. The mutations are selected from one or more, in another embodiment two or more, and in another embodiment three or more of the following: V68A, N87S, S99D, S99SD, S99A, S101G, S103A, V104N/I, Y167A, R170S, A194P, V205I and/or M222S.

Other proteases include metalloproteases and serine proteases, including neutral or alkaline microbial serine proteases, such as subtilisins (EC 3.4.21.62). Suitable proteases include those of animal, vegetable, or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936 B1, U.S. Pat. No. 5,679,630, U.S. Pat. No. 4,760,025, U.S. Pat. No. 7,262,042 and WO09/021,867.

(b) trypsin-type or chymotrypsin-type proteases, such as trypsin (e.g., of porcine or bovine origin), including the *Fusarium* protease described in WO 89/06270 and the chymotrypsin proteases derived from Cellumonas described in WO 05/052161 and WO 05/052146.

(c) metalloproteases, including those derived from *Bacillus amyloliquefaciens* described in WO 07/044,993A2.

Suitable commercially available protease enzymes include those sold under the trade names Alcalase®, Savinase®, Primase®, Durazym®, Polarzyme®, Kannase®, Liquanase®, Ovozyme®, Neutrase®, Everlase®, Blaze® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International (DuPont), those sold under the tradename Opticlean® and Optimase® by Solvay Enzymes, those available from Henkel/Kemira, namely BLAP (sequence shown in FIG. 29 of U.S. Pat. No. 5,352,604 with the following mutations S99D+S101 R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao. In one embodiment is a dual protease system, in particular a system comprising a protease comprising S99SD+S99A mutations (BPN' numbering system) versus either the PB92 wild-type (SEQ ID NO:1) described in U.S. Pat. No. 6,312,936 B1, or the subtilisin 309 wild-type (SEQ ID NO:2) described in U.S. Pat. No. 5,679,630, and a DSM14391 *Bacillus Gibsonii* enzyme, as described in WO 2009/021867 A2.

In another embodiment, the enzyme comprises an amylase wherein the amylase is selected from the group comprising:

a) an amylase exhibiting at least 95% identity with the wild-type enzyme from *Bacillus* sp.707 (SEQ ID NO:7 in U.S. Pat. No. 6,093,562), especially those comprising one or more of the following mutations M202, M208, S255, R172, and/or M261, said amylase comprises one or more of M202L, M202V, M202S, M202T, M202I, M202Q, M202W, S255N and/or R172Q. In one embodiment, the amylase comprises the M202L or M202T mutations; and b) an amylase exhibiting at least 95% identity with the wild-type enzyme from AA560 (SEQ ID NO. 12 in WO 06/002643), especially those comprising one or more of the following mutations 9, 26, 118, 149, 182, 186, 195, 202, 257, 295, 299, 320, 323, 339, 345 and 458 and optionally comprising one or more deletions at 183 and 184.

In another embodiment, the enzyme for use herein includes alpha-amylases, including those of bacterial or fungal origin. Chemically or genetically modified mutants (variants) are included. In one embodiment, the amylase is an alkaline alpha-amylase derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme (SEQ ID NO:3) described in U.S. Pat. No. 5,856,164 and WO99/23211: 26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, in one embodiment that also contain the deletions of D183* and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

(d) variants exhibiting at least 95% identity with the wild-type enzyme from *Bacillus* sp.707 (SEQ ID NO:4) described in U.S. Pat. No. 5,856,164 and WO99/23211, especially those comprising one or more of the following mutations M202, M208, S255, R172, and/or M261. In one embodiment said amylase comprises one or more of M202L, M202V, M202S, M202T, M202I, M202Q, M202W, S255N and/or R172Q. In one embodiment, the amylase comprises the M202L or M202T mutations.

In one embodiment, alpha-amylases include the below variants of SEQ ID NO: 3 described in U.S. Pat. No. 5,856,164:

(a) one or more, in one embodiment two or more, in another embodiment three or more substitutions in the following positions: 9, 26, 149, 182, 186, 202, 257, 295, 299, 323, 339 and 345; and (b) optionally with one or more, in another embodiment four or more of the substitutions and/or deletions in the following positions: 118, 183, 184, 195, 320 and 458, which if present comprise R118K, D183*, G184*, N195F, R320K and/or R458K.

Suitable commercially available alpha-amylases include Duramyl®, Liquezyme®, Termamyl®, Termamyl Ultra®, Natalase®, Supramyl®, Stainzyme®, Stainzyme Plus®, Powerase®, Fungamyl® and Ban® (Novozymes A/S, Bagsvaerd, Denmark), Kemzyme® AT 9000 Biozym Biotech Trading GmbH Wehlistrasse 27b A-1200 Wien Austria, Rapidase®, Purastar®, Enzysize®, Optisize HT Plus® and Purastar Oxam® (Genencor International Inc., Palo Alto, Calif.) and Kam® (Kao, 14-10 Nihonbashi Kayabacho, 1-chome, Chuo-ku Tokyo 103-8210, Japan). Amylases for use herein include Natalase®, Stainzyme®, Stainzyme Plus®, Powerase®, and mixtures thereof.

Other enzymes for use in the detergent composition may be selected from the group comprising hemicellulases, cellulases, cellobiose dehydrogenases, peroxidases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, ß-glucanases, arabinosidases, hyaluronidase, chondroitinase, laccase, and mixtures thereof.

The detergent composition may also comprise two or more amylases for starch soil removal, two or more proteases for protein soil removal, two or more lipases or phospholipases for lipid and oil removal, etc. The use of multiple enzymes for cleaning a soil type can be beneficial. The enzyme for use in the detergent composition is chosen to be effective within the pH range established by the dilution of the enzyme and optional buffering agent in the warewashing machine during the wash cycle.

The detergent composition comprising at least one enzyme may additionally comprise additives known in the art to stabilize enzymes. Non-limiting examples of these additives include sources of calcium such as calcium chloride, calcium acetate and calcium formate. Non-limiting examples of additives to stabilize proteases and lipases include boric acid, phenyl boronic acid, 4-formyl-phenylboronic acid, 2-amino-2-hydroxymethyl-1-propane (TRIS buffer), triethanolamine, glycerol, 1,2-propanediol, and the like.

The enzyme may be present in the detergent composition in an aqueous form, or may be present in a powder, granule or a solid, or can exist as multiple forms when two or more enzymes are dosed as separate detergent compositions. The enzyme containing detergent compositions may be visually homogenous or substantially homogeneous such as in the case of a granular enzyme detergent. The enzyme containing detergent compositions may contain adjuncts such as buffering agents, surfactants, polymers, solvents, salts, and the like, so long as these do not negatively interfere with the stability of the enzymes in the enzyme containing detergent composition.

The enzyme containing detergent composition is dosed into the low temperature fill-and-dump dishwashing machine and diluted to establish a total wash enzyme concentration of from about 0.01 ppm to about 25 ppm, in another embodiment from about 0.05 ppm to about 15 ppm, and in another embodiment from about 0.1 ppm to about 7.5 ppm. The total wash enzyme concentration is herein defined as the sum of the different enzyme concentrations present in the wash. For example, if amylase and protease are present in the enzyme containing detergent composition and dosed, either separately or together, into the low temperature fill-and-dump machine such that the wash concentration of amylase is 0.2 ppm and the wash concentration of protease is 0.5 ppm, the detergent enzyme concentration is determined to be 0.7 ppm.

Sanitizer Mitigator

The sanitizer mitigator is present in the detergent composition which is added during the wash cycle of the low temperature fill-and-dump machine. The sanitizer mitigator may be present in a the detergent composition with the at least one enzyme, or may be present in a separate detergent composition, so long as both detergent compositions are added during the wash cycle. Sanitizer mitigator is added to the wash cycle in order to deactivate sanitizer introduced in the rinse cycle of low temperature fill-and-dump dishwashing machines. These low temperature fill-and-dump machines pass the rinse cycle contents (including fresh water, optional rinse aid and sanitizer) onto the wash cycle for the next set of dishware. Dosing and dilution of the wash cycle components, including the enzyme containing detergent composition, into the wash water results in a combined aqueous composition that comprises the detergent wash compositions and rinse cycle compositions. Enzymes are degraded and rendered inactive by sanitizers such as aqueous chlorine or iodine, and this reduces cleaning effectiveness. It has surprisingly been found that introduction of a sanitizer mitigator deactivates the low-temperature fill & dump sanitizer present in the wash cycle water which results in improved dishware ware cleaning.

The effect of the sanitizer mitigator is surprising given how susceptible enzymes are to hostile chemicals, such as chlorine and iodine, and given the very short wash cycle time frame, typically 45-90 seconds, which the enzyme containing detergent composition has to catalyze food soil cleaning. In one embodiment, the sanitizer mitigator is dosed separately and prior to dosing of the enzyme containing detergent composition. Introduction of a delay between sanitizer mitigator dosing and enzyme detergent composition dosing into the wash cycle can further improve food soil cleaning despite the fact that the operational time frame for the enzyme to work is reduced by the delay.

The sanitizer mitigator comprises any chemical, or set of two or more chemicals, known in the art to react with or bind chlorine or iodine-based sanitizer. In one embodiment, the mitigator is an amine, oligomeric amine or imine, or polyamine or polyimine derivative, wherein sanitizer deactivation is accomplished via the formation N-chlorinated compounds. Non-limiting examples of suitable amines include monoethanolamine, diethanolamine, 'N4 Amine' from BASF, amino acids such as aspartic acid, glutamic acid, glycine, alanine, arginine and lysine, and salts thereof. Polyamines include oligomers and polymers formed by the polymerization of ethylene imine. These oligomers and polymers can be further functionalized, for example, by the reaction of ethylene oxide or propylene oxide, and still be useful in the present invention. Examples of suitable polyethylene imine derivatives are available from BASF under the tradename Lupasol® and from Nippon Shokubai under the tradename Epomin®.

Polyvinyl amines and derivatives of polyvinyl amines comprising some free amine groups can also be used as sanitizer mitigators. Co-polymers of polyvinyl formamide and polyvinyl amine are available from BASF under the tradename Lupamin®. In another embodiment, the mitigator is a reducing agent known to convert chlorine into chloride or iodine (often present as a tri-iodide complex) into iodide. Non-limiting examples of reducing agents include hydrazine and associated salts, ascorbic acid and associated salts, and salts of thiosulfate, metabisulfite and bisulfite. In one embodiment, the reducing agents are sodium thiosulfate, sodium metabisulfite, and sodium bisulfite. In one embodiment, the sanitizer mitigator is selected from the group consisting of sulfite salts, bisulfite salts, thiosulfate salts, and mixtures thereof.

The sanitizer mitigator may be present in the form of a liquid aqueous composition, a liquid nonaqueous composition, or can be powder, granule, or a solid. The sanitizer mitigator can also be a buffering agent. For example, MEA salts of citric acid can be used to provide dual pH buffering and sanitizer mitigation benefits. Similarly, polyamines can be acidified to both buffer and to provide sanitizer mitigator benefits.

The in-wash concentration of sanitizer mitigator in the low temperature fill-and-dump machine is from about 10 ppm to about 1000 ppm, in another embodiment from about 20 ppm to about 500 ppm, and in another embodiment from about 50 ppm to about 500 ppm. In one embodiment, the concentration of sanitizer mitigator dosed in the low temperature fill-and-dump machine is selected to exceed that of the sanitizer on a stoichiometric basis. The ability to determine the stoichiometry of chemical reactions between sanitizer and sanitizer mitigator is considered to be within the skill of one of ordinary skill in the art.

Buffering Agent

The detergent compositions of the present invention may comprise a buffering agent dosed into the low temperature fill-and-dump machine during the wash cycle. Buffering agents, also called 'buffers,' are well known in the art as chemicals that can significantly alter the pH, reserve acidity, or reserve alkalinity of compositions that are otherwise identical in all respects except that they lack the buffering agent. The buffering agent may be a single chemical or may be a combination of two or more chemicals which when combined, act to provide buffering properties. As such, the term buffering agent may include two or more buffering agents. The buffering agent can be organic or inorganic, natural, synthetic or biological. The buffering agent can be solid or liquid at room temperature, or can be present and dosed as an aqueous raw material or a neat liquid. It can also be formed by the reaction of a strong acid and a weak base, or the reaction of a weak acid and a strong base. For example, citric acid and sodium hydroxide can be combined in water to produce acidic pH equilibrium mixtures comprising unreacted citric acid, monosodium citrate, disodium citrate and trisodium citrate. The pH can be buffered over the pH 2.5-7 range by altering the ratio of sodium hydroxide to citric acid. Similarly, sodium bicarbonate can be combined with sodium hydroxide in water to produce alkaline pH equilibrium mixtures of sodium bicarbonate and sodium carbonate, and the buffering properties can be fine tuned over the pH range 8.5-10.5 by changing the sodium bicarbonate to sodium hydroxide ratio.

The buffering agent may be housed within a single detergent composition, but may also be present in two or more separate detergent compositions so long as the detergent compositions are doused in the wash cycle of the low temperature fill-and-dump machine. In one embodiment, the buffering agent is present in the enzyme containing detergent composition, in another embodiment the buffering agent is present in the detergent composition containing sanitizer mitigator, in yet another embodiment the buffering agent is present in both the enzyme containing detergent composition and the detergent composition containing sanitizer mitigator. Multiple detergent compositions each comprising a buffering agent can be beneficial to provide enhanced enzymatic activity or enhanced cleaning. For example, a first detergent composition comprising a buffering agent can provide, upon dosing and dilution during the wash cycle, a favourable pH environment increasing the effectiveness of a first enzyme. Following the dosing and dilution of the first buffering agent and first enzyme, a second detergent composition comprising a second buffering agent can then provide, upon dosing and dilution during the wash cycle, a favourable pH environment favoring the effectiveness of a second enzyme. The manipulation of buffering agents and enzyme dosing sequences can be advantageous for cleaning since it has been surprisingly found that enzyme activity, when optimized, can be effective in a matter of seconds.

Non-limiting examples of suitable inorganic buffering agents include phosphoric acid, hydrochloric acid, methane sulfonic acid, and mixtures thereof; non limiting examples of organic buffering agents acetic acid, adipic acid, glycolic acid, lactic acid, 3-hydroxypropionic acid, succinic acid, ethyl succinic acid, maleic acid, glutaric acid, methyl glutaric acid, glutamic acid, gluconic acid, polyacrylic acid, polyacrylic acid-based copolymers, as wells the sodium, potassium and ammonium salts of the above mentioned organic acids, and mixtures thereof; non limiting examples of alkaline buffering agents include the sodium, potassium and ammonium salts of bicarbonate and carbonate as well as the salts of lysine arginine, ethanolamine, diethanol amine, triethanol amine C1-C22 alkyl amines, diamines and triamines, C1-C22 amines and imine ethoxylates, polymeric amines, imines, and polyamines and imine ethoxylates, and the like.

One of the benefits of buffering agents in the present invention is that they help mitigate changes in pH due to external factors such as effects of wash water hardness and soils. The buffering agents may be selected to regulate wash pH so as to promote favourable enzymatic activity. For example, the buffering agents may be selected to promote activity for enzymes known to be more efficacious at a specific acidic pH or at a range of acidic pH conditions, or can be selected to promote activity for enzymes known to be more efficacious at a specific alkaline pH or at a range of alkaline pH conditions.

The buffering agent is dosed into the dishwashing machine and diluted with wash water to establish a total wash buffering agent concentration from about 10 ppm to about 1000 ppm, in another embodiment from about 20 ppm to 750 ppm, and in another embodiment from about 30 ppm to about 500 ppm. The total wash buffering agent concentration is herein defined as the sum of the concentrations (grams per gram in ppm) of the different externally dosed buffering agents in the wash solution of the machine. For example, if sodium bicarbonate and sodium carbonate are the only buffering agents dosed and diluted into the dishwashing machine to establish a wash concentration comprising 50 ppm sodium bicarbonate and 50 ppm sodium carbonate, the detergent total buffering agent concentration is determined to be 100 ppm.

In one embodiment, a buffering agent is included to provide a detergent composition that is able to reduce lime scale build-up. Municipal water comprises calcium and magnesium ions from dissolved minerals, as well as carbonate species added as water treatment aids, which react to form lime scale. Lime scale deposits as a white precipitate inside dishwashing machines and can cause numerous problems such as the clogging of spray arms, the spotting the silverware, and an increase in bacterial growth.

Lime scale formation is enhanced in dishwashing machines that use detergents having high alkalinity to clean dishware. Commercial establishments have learned to cope with the effects of lime scale by deliming machines using acids such as phosphoric acid and urea sulphate. While the deliming process restores dishwashing machine performance, it also represents an extra step and an extra cost to the user. Deliming solutions are also known to be hazardous and can induce machine corrosion upon repeated use.

It has surprisingly been found that detergent compositions having a pH of from about 4.0 to about 8.5, in another embodiment from about 4.3 to about 8.3, significantly reduces lime scale formation. Below pH of about 4.3, lime scale formation is not possible as the carbonate species is converted into carbon dioxide gas. As the pH increased above pH about 8.3, the bicarbonate is converted into carbonate, and lime scale formation becomes more favourable. Between about pH 4.3 and 8.3, the only non-gaseous carbonate species present in the wash water is bicarbonate, and the reaction of bicarbonate with calcium ions produces calcium bicarbonate which is water soluble. Having the wash water pH be between 4.3 and 8.3 eliminates the potential for lime scale formation, but may also deleteriously impact cleaning. Therefore, the detergent composition of the present invention comprises an enzyme component for cleaning, a sanitizer mitigator introduced into the wash cycle, and a sanitizer component introduced into the rinse cycle.

Cleaning Actives

Any cleaning active can be used as part of the detergent composition of the invention. The levels given are weight percent and refer to the total detergent composition. The detergent compositions may comprise one or more detergent active components selected from surfactants, alkalinity sources, dispersants, builders, anti-corrosion agents, and metal care agents.

Surfactant

Surfactants suitable for use herein include non-ionic surfactants. The detergent composition of the invention is substantially free of anionic and cationic surfactants due to the fact that these types of surfactants cause too much sudsing during the automatic dishwashing process. Sudsing in automatic dishwashing processes are best avoided because they slow down, or even bring to a halt, the rotor of the dishwashing machine.

Traditionally, non-ionic surfactants have been used in automatic dishwashing detergents for surface modification purposes. In particular, non-ionic surfactants have been used for sheeting, to avoid filming and spotting, and to improve shine.

The composition of the invention comprises a non-ionic surfactant or a non-ionic surfactant system having a phase inversion temperature (as measured at a concentration of 1% in distilled water) of about 40° C. to about 70° C., in another embodiment of about 45° C. to about 65° C. A "non-ionic surfactant system" is meant herein as a mixture of two or more non-ionic surfactants.

Phase inversion temperature is the temperature below which a surfactant, or a mixture thereof, partitions into the water phase. Phase inversion temperature can be determined visually by identifying the temperature at which cloudiness occurs. The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is determined using a thermostable bath by immersing the solutions in a 75 mm sealed glass test tube.

In one embodiment, the non-ionic surfactant is an alcohol alkoxylated surfactant. An alcohol alkoxylated surfactant is a compound obtained by the condensation of alkylene oxide groups with an organic hydrophobic material which may be aliphatic or alkyl aromatic in nature, in another embodiment is a compound selected from the group consisting of a C2-C18 alcohol alkoxylated surfactant having EO, PO and/or BO moieties. The moieties can be in block configuration or randomly distributed.

In one embodiment, non-ionic surfactants include the condensation products of alcohols having an alkyl group containing from about 8 to about 14 carbon atoms with an average of from about 6 to about 8 moles of ethylene oxide per mole of alcohol. Commercially available products for use herein include the Lutensol® TO series and the C13 oxo alcohol ethoxylated surfactants supplied by BASF.

Other suitable alcohol ethoxylated surfactants for use herein are C2-C18 alcohol alkoxylated surfactants having EO, PO and/or BO moieties having either random or block distribution. In one embodiment, the surfactant system comprises an ethoxylated alcohol having a C10-C16 alcohol having from 4 to 10 ethoxy groups. The alkoxylated alcohol is present at a level of from about 0.1% to about 20%, in another embodiment from about 1% to about 10%, and in another embodiment from about 4% to about 8% by weight of the detergent composition.

Other example types of nonionic surfactants are linear fatty alcohol alkoxylates with a capped terminal group, as described in U.S. Pat. No. 4,340,766 to BASF.

Other types include olyoxyethylene-polyoxypropylene block copolymers having formula:

$$HO(CH_2CH_2O)a(CH(CH_3)CH_2O)b(CH_2CH_2O)cH;$$

or $$HO(CH(CH_3)CH_2O)d(CH_2CH_2O)e(CH(CH_3)CH_2O)H$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material can for instance have a molecular weight of between about 1,000 and about 15,000, more specifically from about 1,500 to about 6,000. These materials are well-known in the art. They are available under the trademark "Pluronic" and "Pluronic R", from BASF Corporation.

Amine oxides surfactants also useful in the present invention as anti-redeposition surfactants include linear and branched compounds having the formula:

$$R^3(OR^4)xN^{+}(O^{-})(R^5)_2$$

wherein $R^3$ is selected from an alkyl, hydroxyalkyl, acylamidopropoyl and alkyl phenyl group, or mixtures thereof, containing from about 8 to about 26 carbon atoms, in another embodiment from about 8 to about 18 carbon atoms; $R^4$ is an alkylene or hydroxyalkylene group containing from about 2 to about 3 carbon atoms, in another embodiment from about 2 carbon atoms, or mixtures thereof; x is from 0 to 5, in another embodiment from 0 to 3; and each $R^5$ is an alkyl or hydroxyalkyl group containing from 1 to 3, in another embodiment from 1 to 2 carbon atoms, or a polyethylene oxide group containing from 1 to 3, in one embodiment 1, ethylene oxide groups. The R5 groups can be attached to each other, e.g., through an oxygen or nitrogen atom, to form a ring structure.

Non-ionic surfactants may be present in amounts from about 0% to about 10%, in another embodiment from about 0.1% to about 10%, and in another embodiment from about 0.25% to about 6% by weight of the total composition.

Builders

The compositions may include one or more builders. Builders are known in the art as chemical raw materials that either complex or precipitate calcium. Examples of builders include amino acid-based or succinate-based compounds. In one embodiment, the builder is methyl-glycine-diacetic acid (MGDA) and salts thereof. In another embodiment, the amino acid is glutamic-N,N-diacetic acid (GLDA) and salts thereof. Succinate-based builders are described in U.S. Pat. No. 5,977,053 incorporated herein by reference. In another embodiment, builders can be phosphorus based compounds, including phosphate and phosphonate acids or salts, sand mixtures thereof. Non-limiting examples of phosphates include, phosphoric acid, sodium tri-poly phosphate, non-limiting examples of phosphonates include diethylene traimeine penta (methylene phosphonic acid) and 1-Hydroxy Ethylidene-1,1-Diphosphonic acid. When present, the level of phosphate or phosphonate is no greater than 0.5% measured as elemental phosphorus. For example, HEDP (1-Hydroxy Ethylidene-1,1-Diphosphonic acid AKA Etidronic acid) has molecular weight 206 g/mol, and so the maximum level of HEDP in the composition is 0.5%*206//(2*31) or 1.66% HEDP.

Foam Control Agents

The compositions can comprise one or more foam control agents. The foam control agents are selected from the group consisting of straight chain and branched fatty acids, silicones and oils such as paraffin oil. In one embodiment, the foam control agents are present in amounts less than 5% by weight of the total detergent composition; in another embodiment, the foam control agents are present in amounts less than about 2% by weight of the detergent composition.

Organic Polymers

The organic polymer, if present, is used in any suitable amount of from about 0.1% to about 50%, in another embodiment from about 0.5% to about 20%, in another embodiment from about 1% to about 10% by weight of the composition.

Organic polymers herein include acrylic acid containing polymers such as Sokalan PA30, PA20, PA15, PA10 and Sokalan CP10 (BASF GmbH), Acusol 45N, 480N, 460N (Rohm and Haas), acrylic acid/maleic acid copolymers such as Sokalan CP5 and acrylic/methacrylic copolymers. Organic polymers useful herein as soil release polymers include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

In one embodiment, sulfonated/carboxylated polymers are present for use in the composition of the invention. Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, in one embodiment from about 5,000 Da to about 45,000 Da.

Carboxylic acid monomers include one or more of the following: acrylic acid, maleic acid, itaconic acid, methacrylic acid, or ethoxylate esters of acrylic acids, acrylic and methacrylic acids. Sulfonated monomers include one or more of the following: sodium(meth)allyl sulfonate, vinyl sulfonate, sodium phenyl(meth)allyl ether sulfonate, or 2-acrylamido-methyl propane sulfonic acid. Non-ionic monomers include one or more of the following: methyl (meth)acrylate, ethyl(meth)acrylate, t-butyl(meth)acrylate, methyl(meth)acrylamide, ethyl(meth)acrylamide, t-butyl (meth)acrylamide, styrene, or α-methyl styrene.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, alkali metal ions and sodium ions.

Metal Care Agents

Metal care agents may be included in the composition to prevent or reduce the tarnishing, corrosion, or oxidation of metals, including aluminium, stainless steel and non-ferrous metals, such as silver and copper. Suitable examples include one or more of the following:

(a) benzatriazoles, including benzotriazole or bis-benzotriazole and substituted derivatives thereof. Benzotriazole derivatives are those compounds in which the available substitution sites on the aromatic ring are partially or completely substituted. Suitable substituents include linear or branch-chain C1-C20-alkyl groups and hydroxyl, thio, phenyl or halogen such as fluorine, chlorine, bromine and iodine.

(b) metal salts and complexes chosen from the group consisting of zinc, manganese, titanium, zirconium, hafnium, vanadium, cobalt, gallium and cerium salts and/or complexes, the metals being in one of the oxidation states II, III, IV, V or VI. In one aspect, suitable metal salts and/or metal complexes may be chosen from the group consisting of Mn(II) sulphate, Mn(II) citrate, Mn(II) stearate, Mn(II) acetylacetonate, K2TiF6, K2ZrF6, CoSO4, $Co(NO3)_2$ and Ce(NO3)3, zinc salts, for example zinc sulphate, hydrozincite or zinc acetate.

(c) silicates, including sodium or potassium silicate, sodium disilicate, sodium metasilicate, crystalline phyllosilicate and mixtures thereof.

B. Rinse Cycle Components

Sanitizer

Sanitizer is added during the rinse cycle of low temperature fill-and-dump dishwashing machines. Low temperature fill-and-dump machines comprise chlorine or iodine-based sanitizers. Chlorine based sanitizers are typically pH 11 to 14 compositions comprising about 2% to about 15% sodium hypochlorite active. Other hypochlorite cations can also be used, including but not limited to, lithium, potassium, calcium and the like. The chlorine sanitizer is dosed and diluted into the rinse water to achieve a minimum in-use 'free chlorine' level of 25 ppm, in another embodiment 50 ppm. Recommended concentrations of free chlorine are from about 50 ppm to about 200 ppm, in another embodiment from about 50 ppm to about 100 ppm. By 'free chlorine' it is meant the amount of chlorine released when chlorine-containing compounds such as sodium hypochlorite are treated with acid. The terms 'free chlorine' and 'available chlorine' are widely used in the literature and are interchangeable for purpose of the present invention. Non-limiting examples of commercially available chlorine sanitizers used in the present invention include 'Ultra San' from Ecolab and 'Interchlof' from Intercon. Iodine-based sanitizers typically are 1% to about 5% active raw solutions with activity of 1% to about 10%, and are formed by combining iodine, or mixtures of iodine and iodide with solubilizing agents such as poly(vinylpyrrolidone) and polyether oligomers and polymers such as poly(ethylene oxide), poly(propylene oxide) and co-polymers comprising poly(ethylene oxide) and poly(propylene oxide). The iodine sanitizer can also be available in the form of a more conventional C6-C18 poly(ethylene oxide) or C6-C18 aryloxy poly(ethylene oxide) non-ionic surfactants such as nonylphenoxy(ethylene oxide) and decyl(ethylene oxide), where the term 'ethylene oxide' denotes 1-60 units of either ethylene oxide linked together. The iodine sanitizer is delivered in the rinse cycle to achieve a minimum in-use iodine level from about 5 ppm to about 100 ppm, more preferably from about 12.5 ppm to about 25 ppm. Non-limiting examples of commercially available iodine-based sanitizers include 'sani-rinse' available from Intercon and 'saniware' available from Daley International.

Rinse Aid

In one embodiment, rinse aid is added to the rinse cycle along with sanitizer. The term, "rinse aid," means a composition which is introduced into an automatic dishwashing machine during its rinse cycle for purposes of anti-corrosion, anti-filming, anti-spotting, and the like.

The rinse aid composition may comprise a water soluble alkoxylated acrylic acid polymer. The polymer should have a molecular weight of from about 2,000 to about 20,000, or from about 3,000 to about 15,000, or from about 5,000 to about 13,000. The alkylene oxide (AO) component of the polymer is generally propylene oxide (PO) or ethylene oxide (EO) and generally comprises from about 20 wt % to about 50 wt %, or from about 30 wt % to about 45 wt %, or from about 30 wt % to about 40 wt % of the polymer. The alkoxylated side chains of the water soluble polymers may comprise from about 10 to about 55 AO units, or from about 20 to about 50 AO units, or from about 25 to 50 AO units. The water soluble polymers may be configured as random, block, graft, or other known configurations. Methods for forming alkoxylated acrylic acid polymers are disclosed in U.S. Pat. No. 3,880,765. The water soluble polymer should comprise from about 1 wt % to about 30 wt % of the rinse aid composition.

The water soluble polymer herein provides anti-spotting and anti-filming benefits when incorporated into rinse aid compositions as a rinse aid additive. Without being limited by theory, the water soluble polymer has strong calcium ion binding ability, while having water hardness tolerance. As used herein, polymers with "water hardness tolerance" do not readily precipitate from water upon binding to calcium ions.

The rinse aid compositions herein may additionally include an acid. Any suitable organic and/or inorganic acid in any suitable amount may be used in the rinse aid compositions. Some suitable acids include, but are not limited to: acetic acid, aspartic acid, benzoic acid, boric acid, bromic acid, citric acid, formic acid, gluconic acid, glutamic acid, lactic acid, malic acid, nitric acid, sulfamic acid, sulfuric acid, tartaric acid, and mixtures thereof.

The rinse aid compositions herein may additionally include non-ionic surfactants. Any suitable non-ionic surfactant in any suitable amount may be used to make the rinse aid composition. Suitable non-ionic surfactants include, but are not limited to, low foaming nonionic surfactants (LFNIs) such as the ones listed above in the detergent composition.

Any suitable carrier medium in any suitable amount may be used to make the rinse aid composition. Suitable carrier mediums include both liquids and solids. In one non-limiting embodiment, the rinse aid composition comprises: (a) a water soluble alkoxylated acrylic acid polymer described herein; (b) a non-ionic surfactant; (c) an acid; and (d) at least one component selected from the group consisting of dispersant polymer, perfume, hydrotrope, binder, carrier medium, antibacterial active, dye, zinc carbonate, zinc chloride, and mixtures thereof. The rinse aid composition should have a pH of less than about 6 when measured at a 1% concentration in an aqueous solution.

C. Forms

All-in-One Detergent Composition

In the context of the present invention, the all-in-one detergent composition comprises the enzyme component and the sanitizer mitigator component in the same enzyme containing detergent composition. In one embodiment, the all-in-one composition further comprises a buffering agent. In another embodiment, the enzyme containing detergent composition additionally comprises a low-foaming non-ionic surfactant. The all-in-one composition can have an acidic pH or an alkaline pH, and is dosed into the wash cycle of the fill-and dump dishwashing machine of the present invention. Acidic all-in-one compositions have pH, measured as a 1% aqueous solution in de-ionized water, from about 1 to about 7, in another embodiment from about 2 to about 7, in another embodiment from about 3 to about 7, and in another embodiment from about 4 to about 7. Alkaline all-in-one compositions have pH, measured as a 10% aqueous solution, from about 7 to about 13, in another embodiment from about 7 to about 12, in another embodiment from about 7 to about 11, and in another embodiment from about 7 to about 10. In yet another embodiment, the pH of the all-in-one composition measured as a 1% aqueous solution in de-ionized water is not alkaline, and is from about 2.5 to about 10.5, in another embodiment from about 4.3 to about 8.3. While not wishing to be limited by theory, it is believed that the best selection of all-in-one composition pH is governed by several factors, including but not limited to, enzyme stability and activity as a function of pH, impact of buffering agent if present on metal corrosion, compatibility of the sanitizer mitigator with the enzyme choice, and the like.

The all-in-one composition can be a solid, powder, granule or granular, paste, non-aqueous liquid or aqueous liquid. Those skilled in the art will recognize that dissolution rates for each of the required components in the all-in-one detergent composition can be different from one another. In one embodiment, the dissolution rate for the enzymes in the composition is slower than the dissolution rate of the sanitizer mitigator to enable the sanitizer mitigator to partially or fully deactivate the sanitizer prior to complete enzyme dissolution. In another embodiment, the dissolution rate for the enzymes in the composition is slower than the dissolution rate of the optional buffering agent to enable the buffering agent to provide a favourable pH environment for enzyme activity prior to complete enzyme dissolution.

Two Separate Detergent Compositions

In one embodiment, the detergent composition of the present invention comprises two separate detergent compositions dosed independently of each other, both during the machine wash cycle: a detergent composition comprises at least one sanitizer mitigator (detergent 1), and an enzyme containing detergent composition (detergent 2). Buffering agent can optionally be present in either or both of the detergent compositions. The first detergent composition can optionally also comprise at least one additional enzyme, and the second detergent composition can also optionally comprise at least one additional sanitizer mitigator. In one embodiment, the first detergent composition comprises a single sanitizer mitigator and the second detergent composition comprises at least two enzymes. In another embodiment, the first detergent composition comprises a single sanitizer mitigator and the second detergent composition comprises at least three enzymes. The selection of two separate detergent compositions, as opposed to a single detergent composition, can provide additional composition stability and operational degrees of freedom.

In one embodiment, the two detergent compositions are dosed and diluted into the machine during the wash cycle at nearly at the same time or at overlapping intervals of time. Simultaneous or near-simultaneous dosing of the two separate detergent compositions can maximize the exposure time of the enzyme to the soiled ware within the machine wash cycle, and can be used in instances in which the second detergent composition enzyme or enzymes are not especially sensitive to the effects of low levels, usually sub ppm levels, of unreacted residual sanitizer or chlorine in the water. While not wishing to be limited by theory, it is believed that the reaction of sanitizer and sanitizer mitigator is nearly complete within one second in the machine wash cycle, but that residual amounts of sanitizer can persist for many seconds more.

In another embodiment, the two detergent compositions can be dosed at different times, or over non-overlapping intervals of time. In one embodiment, the dosing time interval for the second detergent composition, which comprises at least one enzyme, is initiated at the same time or about 1 to 30 seconds later, than the initiation of the first detergent composition dosing so as to maximize the ability for the sanitizer mitigator to fully deactivate the sanitizer prior to the second detergent dosing.

The concentration of sanitizer mitigator in the first detergent is from about 1% to about 30%, in another embodiment from about 2% to about 25%, and in another embodiment from about 3% to about 20% by weight of the total composition. The total concentration of enzyme in the second detergent composition is from about 0.1% to about 10%, in another embodiment from about 0.2% to about 5%, and in another embodiment from about 0.3% to about 3% by weight of the total composition.

In one embodiment, the two detergent compositions are dosed into the machine via two independently actuated dosing systems. For example, the first detergent composition can be an aqueous composition and the second detergent composition can be an enzyme prill, or a cocktail of encapsulated enzymes in granular or powder form. Alternatively, the first detergent composition can be a solid comprising one or more buffering agents, and the second detergent composition can be an aqueous composition comprising one or more enzymes. In yet another example, the first detergent composition and the second detergent composition can both be aqueous compositions. Any powder, solids or liquid (aqueous or non-aqueous) dosing system known in the art can be used in the present invention to transfer and dilute the first and second detergent compositions into the low temperature fill-and-dump dishwashing machine.

In another embodiment, the first and second detergent compositions can be dosed via a single actuated dosing system; for example, the two compositions can be present in the form of a tablet wherein the two separate compositions are separated by a barrier such as a film, to prevent chemical or physical interaction between the first and second detergent compositions.

EXAMPLES

Chemical Compositions:

The following compositions were prepared as illustrative examples of the present invention—all raw materials are provided on a weight active basis:

Detergent 1 (wash detergent with sanitizer mitigator prepared in de-ionized water): 20% citric acid (Tate & Lyle), 12% sodium hydroxide (Formosa Plastics), 7.5% sodium bisulfite, (Hydrite Chemical), 1-2 benzisothiazolin-3-one (Dow Chemical); The pH of the composition is 5.5.

Comparable Detergent 1 (wash detergent without sanitizer mitigator prepared in de-ionized water): 20% citric acid (Tate & Lyle), 11.5% sodium hydroxide (Formosa Plastics), 0.015% 1,2-Benzisothiazolin-3-one (Dow). The pH of the composition is 5.6.

Detergent 2 (enzymatic wash detergent): 0.485% α-amylase ("Natalase 200L", Novozymes), 1.455% serine protease ("Savinase Ultra 16XL", Novozymes), 2.5% calcium formate (Perstorp), 0.015% 1,2-benzisothiazolin-3-one (Dow).

"DCT AutoDish Rinse' (Diversified Chemical Technologies) is used as the rinse aid. Ultra San (8.4% sodium hypochlorite. Ecolab) is used as the sanitizer.

Substrates: Spaghetti slides are prepared to evaluate the performance of the amylase and egg-in-bowls were used to evaluate the performance of the protease.

Test Product Systems

System A:

Wash detergents: Detergent 1 with sanitizer mitigator (sodium bisulfite)+detergent 2

Rinse Aid: DCT Auto Rinse

Sanitizer: Ecolab Ultra San

System B:

Wash detergents: Detergent 1 with sanitizer mitigator (sodium bisulfite); no detergent 2

Rinse Aid: DCT Auto Rinse

Sanitizer: Ecolab Ultra San

System C:

Wash detergents: Detergent 1 without sanitizer mitigator (sodium bisulfite)+detergent 2

Rinse Aid: DCT Auto Rinse

Sanitizer: Ecolab Ultra San

System D:

Wash detergents: Detergent 1 without sanitizer mitigator (sodium bisulfite); no detergent 2

Rinse Aid: DCT Auto Rinse

Sanitizer: Ecolab Ultra San

Dosing & Test Product Dilution:

Testing is conducted using a model AF-3D-S low-temperature fill-and-dump dishwasher manufactured by American Dish Service (Kansas City, Kans., USA). For each cleaning cycle, wash detergent 1 and wash detergent 2 are hand-dosed, achieving a detergent dilution of 2 ml/L for detergent 1 and 0.2 ml/L for detergent 2. The concentration of citrate (as citric acid) for test systems A, B, C & D is about 400 ppm following detergent 1 dilution into the dishwasher; the concentration of sanitizer mitigator for test systems A & B is about 150 ppm following detergent 1 dilution into the dishwasher; the concentration of enzyme for test systems A & C is about 1 ppm α-amylase and 3 ppm protease following detergent 2 dilution into the dishwasher.

Test Soils

Egg in bowl soil: Eggs are used as a proxy for protein soil. Large eggs are thoroughly whisked together to form a substantially uniform mixture, and 50 mls of the egg mixture are dispensed into porcelain bowls each comprising approximately 5 grams of room temperature butter. The butter and whisked egg mixture are then manually homogenized. The soiled porcelain bowls are placed in a microwave at high heat for 105 seconds, cut into 2.5 cm×2.5 cm pieces while still in the microwave, and then heated again in the microwave for approximately 120 seconds. The bowls are removed from the microwave, allowed to cool and the large pieces of egg are then scraped off to simulate leftover egg pieces following a meal.

Spaghetti on slide soil: Spaghetti is used as a proxy for starch soil. Cooked spaghetti is pureed in a blender to produce substantially homogenous spaghetti slurry. Pre-weighed microscope slides are dipped into the pureed spaghetti mixture, and spaghetti on the back side of each dipped slide is wiped off with a paper towel. The weight of the puree on each coated microscope slide is between about 20 mg and 45 mg, uniformly covering about two-thirds of the microscope slide. Sets of soiled microscope slides are then baked in a convection oven for a total of about 90 minutes at approximately 125° C. Following cool down, the weights of the coated and baked microscope slides are recorded.

Machine Test:

For each cycle, four slides soiled with baked spaghetti slurry are clipped to each of two plexi-glass plates that are placed on a dishwashing machine rack along with two porcelain bowls comprising egg remnants. Each rack is passed into the dishwashing machine and cleaning is accomplished using the detergent systems and dosing levels previously specified. When a cycle (wash cycle+rinse cycle) is completed, the contents of the rack are removed allowing the rack to be reused. The spaghetti slides are removed from the plexi-glass plates and dried in an oven at 100° C. for 60 minutes, followed by cooling to room temperature for another 60 minutes. Following cool down, the weights of the washed and baked microscope slides are recorded. Results are reported as milligrams of soil removed. The porcelain bowls are dried in ambient conditions for 60 minutes. The bowls are then stained with safranin red dye, which colours the remaining egg soil pink. The porcelain bowls are graded using a pictorial grading scale. A total of ten cycles are run for each of the four detergent systems A, B, C & D.

Results

Results for spaghetti slides are reported as milligrams of soil removed from the microscope slide.

| | System A | System B | System C | System D |
|---|---|---|---|---|
| Spaghetti Slides (mg soil removed for cycle 1) | 33.06 | 10.93 | 34.68 | 11.95 |
| Spaghetti Slides (mg soil removed for cycles 2-10) | 25.96 | 11.19 | 10.21 | 10.41 |

Sanitizer is present in cycle 1, but is present for cycles 2-10. The performance differences between cycle 1 and cycles 2-10 can therefore be ascribed to the effects of the sanitizer on systems A, B, C & D. Systems B & D, which do contain enzyme, consistently perform poorly. System A, which contains both enzyme (amylase) and sanitizer mitigator strongly outperforms system C, which contains no sanitizer mitigator for cycles 2-10.

Results for egg soil are reported as numerical grades. The grades range from 1-10, 1 being the most soiled and 10 being the cleanest.

| | System A | System B | System C | System D |
|---|---|---|---|---|
| Egg Soil (cycle 1) | 4 | 1 | 1 | 4 |
| Egg Soil (cycle 2-10) | 5 | 1 | 1 | 3 |

As can be seen from the results, the best performance results are obtained for System A which contains both enzyme and sanitizer mitigator.

Limescale Test

Multicycle testing is used to estimate limescale build-up over time. The machine is run for 300 cycles under hard water (300 ppm as $CaCO_3$) conditions; drinking glasses are used as substrates for scale visualization. The test products are specified below using the dosing levels previously specified.

Test Product Systems

System A:

Wash detergents: Detergent 1 with sanitizer mitigator (sodium bisulfite)+detergent 2

Rinse Aid: DCT Auto Rinse

Sanitizer: Ecolab Ultra San

System E:

Wash detergents: Ecolab Ultra Klene

Rinse Aid: Ecolab Ultra Dry

Sanitizer: Ecolab Ultra San

Figure 2:
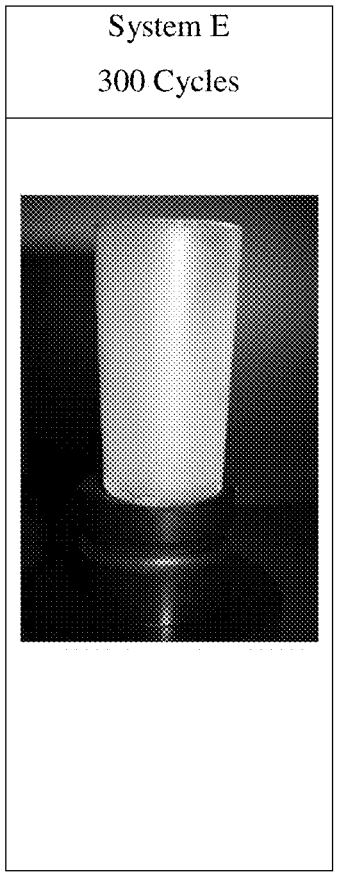
FIG. 2 is an image of glassware that has been repeatedly cleaned using a test system in which limescale build-up is visually apparent.

Results:

FIGS. 1 and 2 show results of System A and E.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of cleaning dishware in a low temperature fill-and-dump dishwashing machine, the method consisting of the steps of:

(a) placing an acidic detergent composition with wash water in a low temperature fill-and-dump dishwashing machine during a machine wash cycle, the acid detergent composition comprising at least one enzyme and at least one sanitizer mitigator;

(b) dumping substantially all of the wash water containing the acidic detergent composition from the low temperature fill-and-dump dishwashing machine;

(c) adding a sanitizer and fresh rinse water during a machine rinse cycle, wherein the sanitizer comprises at least one chlorine or iodine-based compound, wherein the fresh rinse water and the sanitizer is wash water for a subsequent machine wash cycle; and wherein the pH of the composition in the wash cycle is about 4.3 to about 7 and the temperature of the low temperature fill-and-dump dishwashing machine during the wash cycle and the rinse cycle is from about 49° C. to about 60° C.

2. The method of cleaning dishware according to claim 1, wherein the detergent composition further comprises a buffering agent and wherein the buffering agent is selected from the group consisting of citric acid, lactic acid, gluconic acid, salts of citric acid, lactic acid, gluconic acid, salts of bicarbonate and carbonate, and mixtures thereof.

3. The method of cleaning dishware according to claim 1, wherein the enzyme is selected from the group consisting of amylases, proteases, lipases, and mixtures thereof.

4. The method of cleaning dishware according to claim 1, wherein the sanitizer mitigator is selected from the group consisting of sulphite salts, bisulfite salts, thiosulfate salts, and mixtures thereof.

5. The method of cleaning dishware according to claim 1, wherein the sanitizer mitigator is selected from the group consisting of amines, oligomeric amines, oligomeric imines, polyamine derivatives, and mixture thereof.

6. The method of cleaning dishware according to claim 1, wherein the sanitizer is chlorine or iodine.

7. The method of cleaning dishware according to claim 1, wherein the rinse cycle further comprises an addition of a rinse aid.

8. A method of cleaning dishware in a low temperature fill-and-dump dishwashing machine, the method consisting of the steps of:

(a) placing a first acidic detergent composition with wash water in a low temperature fill-and-dump dishwashing machine during a machine wash cycle, the first acidic detergent composition comprising at least one enzyme;

(b) adding a second acidic detergent composition to the wash water of the machine wash cycle after the first acidic detergent composition, wherein the second acidic detergent composition comprises sanitizer mitigator;

(c) dumping substantially all of the wash water containing the first and second acidic detergent compositions;

(d) adding a sanitizer and a rinse aid with fresh rinse water during a machine rinse cycle, wherein the sanitizer comprises at least one chlorine or iodine-based compound, wherein the fresh rinse water, the rinse aid, and the sanitizer is wash water for a subsequent machine wash cycle; and wherein the pH of the first and second acidic compositions in the wash cycle is about 4.3 to about 7 and the temperature of the low temperature fill-and-dump dishwashing machine during the wash cycle and the rinse cycle is from about 49° C. to about 60° C.

9. The method of cleaning dishware according to claim 8, wherein the second detergent further comprises a buffering agent selected from the group consisting of citric acid, lactic acid, gluconic acid, salts of citric acid, lactic acid, gluconic acid, salts of bicarbonate and carbonate, and mixtures thereof.

10. The method of cleaning dishware according to claim 8, wherein the enzyme is selected from the group consisting of amylases, proteases, lipases, and mixtures thereof.

11. The method of cleaning dishware according to claim 8, wherein the sanitizer mitigator is selected from the group consisting of sulfite salts, bisulfite salts, thiosulfate salts, and mixtures thereof.

12. The method of cleaning dishware according to claim 8, wherein the sanitizer is chlorine or iodine.

* * * * *